US006618906B2

(12) United States Patent
Ciesiun

(10) Patent No.: US 6,618,906 B2
(45) Date of Patent: Sep. 16, 2003

(54) DEVICE FOR SECURING A LIGHTING APPARATUS TO A PAINTBALL MASK

(75) Inventor: Paul M. Ciesiun, Manhattan, IL (US)

(73) Assignee: Skeleton Crew Entertainment, Inc., Manhattan, IL (US)

( * ) Notice: Subject to any disclaimer, the term of this patent is extended or adjusted under 35 U.S.C. 154(b) by 0 days.

(21) Appl. No.: 09/862,411

(22) Filed: May 22, 2001

(65) Prior Publication Data

US 2002/0174520 A1 Nov. 28, 2002

(51) Int. Cl.[7] ..... A42B 3/00; A44B 21/00; A45F 5/00; F21L 15/14

(52) U.S. Cl. ..... 24/3.12; 24/3.1; 24/3.11; 24/336; 124/31; 362/105; 362/106

(58) Field of Search ..... 24/3.11, 3.12, 24/3.1, 523, 597; 362/105, 106; 124/31

(56) References Cited

U.S. PATENT DOCUMENTS 1,016,730 A * 2/1912 Bartley ..... 362/106
1,510,822 A * 10/1924 Berndt ..... 24/3.11
2,765,398 A * 10/1956 Mays ..... 362/106
3,069,539 A * 12/1962 Kidd ..... 24/3.11
4,793,007 A * 12/1988 Barnett ..... 362/106
4,967,323 A * 10/1990 Johnson et al. ..... 362/105
5,341,513 A * 8/1994 Klein et al. ..... 362/106
5,540,368 A * 7/1996 Oliva ..... 24/3.12
5,762,058 A * 6/1998 Cheng et al. ..... 124/56
5,867,874 A * 2/1999 Simpson ..... 24/3.12
6,189,525 B1 * 2/2001 Kutrubes ..... 124/31
6,206,543 B1 * 3/2001 Henry ..... 362/105

* cited by examiner

*Primary Examiner*—Victor Sakran
(74) *Attorney, Agent, or Firm*—Cherskov and Flaynik

(57) ABSTRACT

A device 10 for securing a lighting apparatus 11 to a paintball mask to promote night paintball includes a base member 12, a light support member 14 extending forward from an upper portion of the base member 12, a light positioning member 16 extending forward from a lower portion of the base member 12, the light support and light positioning members 14 and 16 cooperating to secure and position the lighting apparatus 11 with the base member 12 to focus light in a predetermined direction, a stabilizing clip 18 extending rearward from a lower portion of the base member 12, and a pair of apertures 20 disposed through opposing upper portions of the base member 12, the apertures 20 ultimately receiving therethough a support belt 72 that cooperates with the stabilizing clip 18 to maintain the position of the device 10 relative to the paintball mask during play of a night paintball game.

17 Claims, 7 Drawing Sheets

DEVICE FOR SECURING A LIGHTING APPARATUS TO A PAINTBALL MASK

BACKGROUND OF THE INVENTION

1. Field of the Invention

The present invention relates to the game and/or sport of paintball and more particularly, to a device that allows the paintball to be played at night without illuminating the entire field of play that the players are competing upon.

2. Background of the Prior Art

Paintball is a fast growing game played mainly outdoors during daylight hours upon large areas of natural terrain. The object of the game is to strike an opposing player (identified as such by an armband with markings thereon) with a paintball projected from a specially designed "gun." The paintball includes a soft outer shell that collapses upon striking a targeted player thereby releasing an internal fluid that adheres to and identifies the player as being "hit" which relegates him to observer status in a neutral zone for the remainder of the game. A terrain with trees, hills and natural "hiding" places enhances the game of paintball making it more exciting and limited only by the rules of the game and the imagination of the players. Thus, the more "wild" the terrain, the more exciting the game but the greater the possibility of player injury. A primary objective of the game of paintball is safety which necessitates that the game be played during daylight hours. The problem with playing the game of paintball during daylight hours is that the element of surprise is limited when compared to playing a game of paintball during the night time hours upon an unlit, dark field.

One method to promote night paintball and to provide a reasonable degree of safety is to mount stationary lighting that illuminates a potentially dangerous portion of the entire field of play. Another method would be to light the entire field of play. Either method would attenuate the goal of creating an element of surprise. The most economical and efficient method to provide lighting for conducting a game of night paintball, is to have each player carry the means for illuminating an "area of safety" that allows that player to participate in a game of paintball.

Therefore, equipment is required that allows a player to safely participate in a game of night paintball when played upon a dark field. The equipment must have the capability of illuminating an area proximate to the player to prevent injury, yet minimizes the likelihood of being observed by an opposing player. Further, the equipment must be secured to the person of the player such that his or her arms are free to carry and activate a paintball gun. Besides safety equipment, means for identifying in the dark the team a player belongs to and means for displaying in the dark when a player has been struck by a paintball, are also required for conducting a game of night paintball.

SUMMARY OF THE INVENTION

It is an object of the present invention to overcome many of the disadvantages associated with daylight paintball equipment used for night paintball.

A principle object of the present invention is to provide a device that secures a lighting apparatus to a paintball mask. A feature of the device is a light support member that is distally positioned relative to a base member that attaches to the paintball mask. An advantage of the device is that the light support member unobtrusively joins the lighting apparatus to the paintball mask.

Another object of the present invention is to maintain a preselected orientation of the lighting apparatus in relation to device. A feature of the device is a plurality of ridges disposed upon a lower arcuate portion of the light support member. An advantage of the device is that a beam of light emitted from the lighting apparatus is kept substantially stable in relation to the device.

Yet another object of the present invention is to position the lighting apparatus. A feature of the device is a light positioning member disposed proximate to the light support member such that the light positioning member engages and angles upward the lighting apparatus when the apparatus is attached to the light support member. An advantage of the device is that the a beam of light emitted from the lighting apparatus is direct in a generally upward direction that is conducive to night paintball play.

Another object of the present invention is to stabilize the lighting apparatus in relation to the paintball mask. A feature of the device is a clip integrally joined to back wall of the base member, the clip removably receiving a corresponding portion of the paintball mask therein. An advantage of the device is that movement of lower portions of the lighting apparatus relative to the paintball mask is minimized or eliminated.

Another object of the present invention is to removably receive support belts that join the base member to the paintball mask. A feature of the device is a pair of oppositely angled, distally positioned apertures through an upper portion of the base member. An advantage of the device is that the support belts through the apertures maintain the horizontal and vertical positions of the lighting apparatus relative to the paintball mask.

Another object of the present invention is to enable a paintball game to played in the dark. A feature of the device is the joining of a lighting apparatus to a paintball mask. An advantage of the device is that a player can safely play a game paintball in the dark.

Briefly, the invention provides a device for securing a lighting apparatus to a paintball mask comprising means for joining the lighting apparatus to a base member of said device; means for positioning the lighting apparatus; and means for connecting said base portion to the paintball mask.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DETAILED DESCRIPTION OF THE PREFERRED EMBODIMENT

Figure 1:
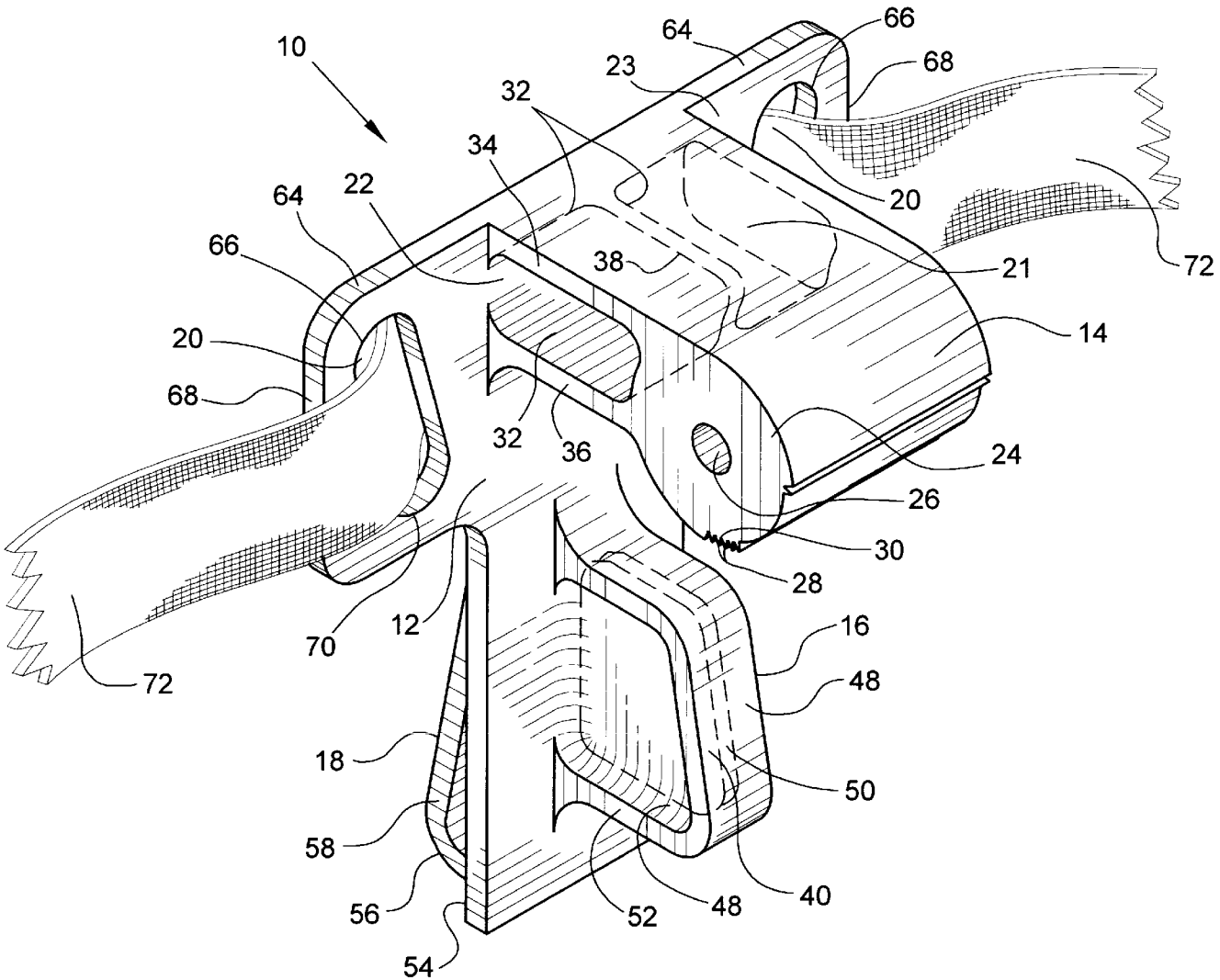
FIG. 1 is a perspective view of a device for securing a lighting apparatus to a paintball mask in accordance with the present invention.
Figure 2:
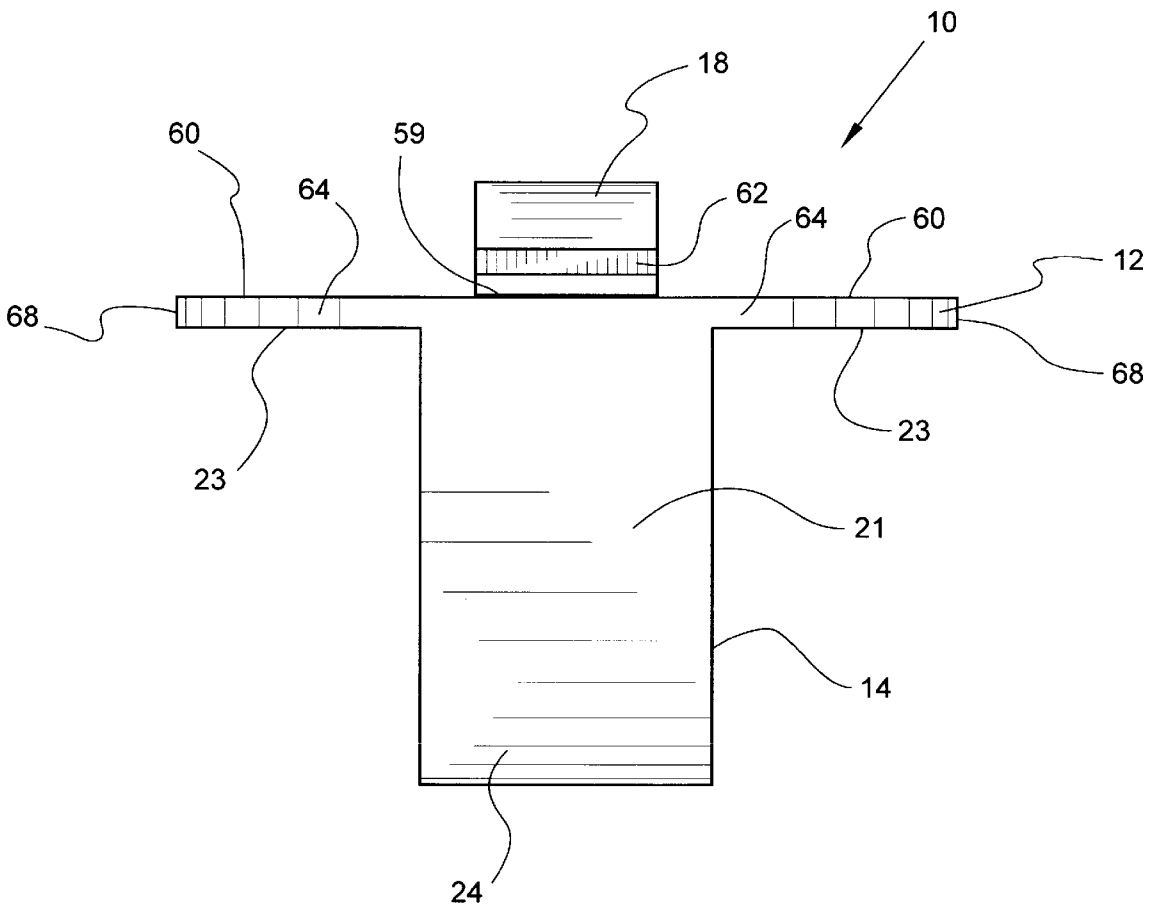
FIG. 2 is a top elevation view of the device of FIG. 1.
Figure 3:
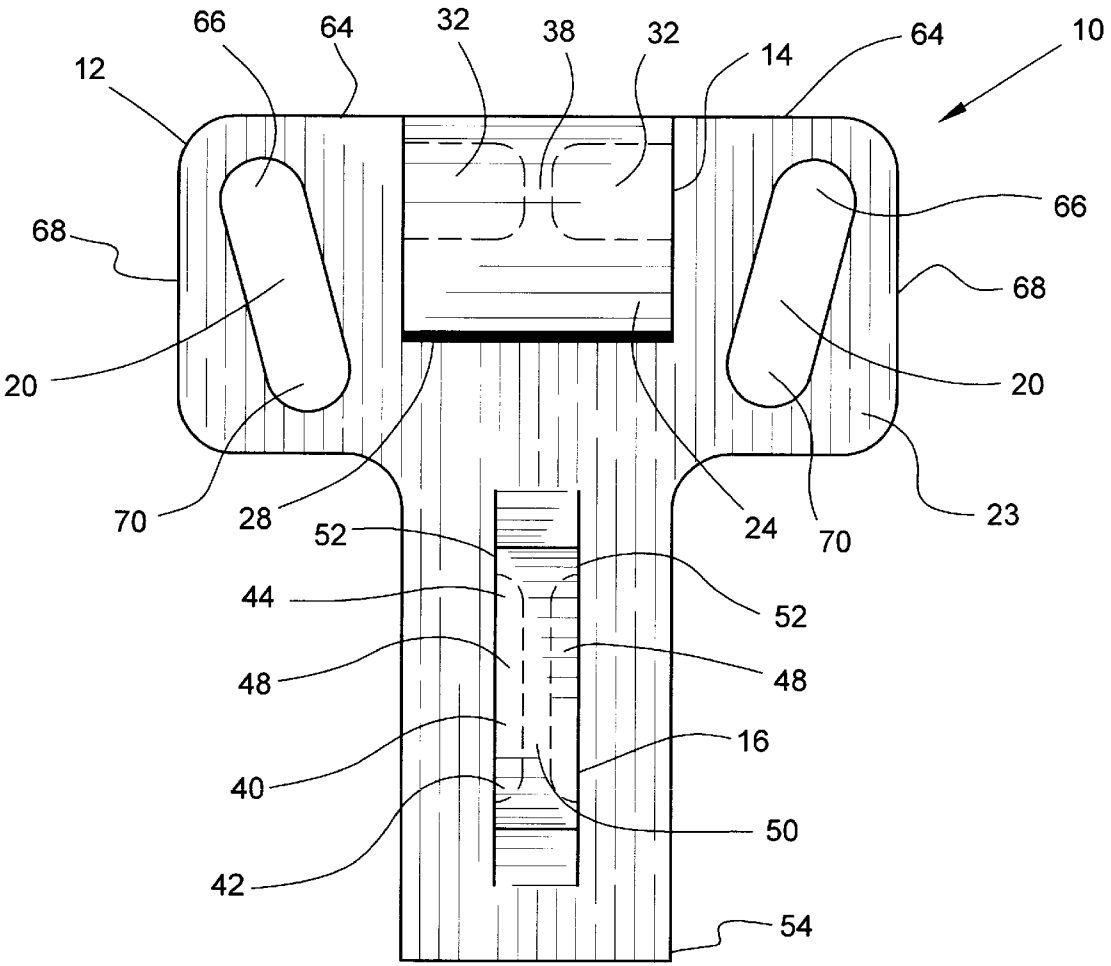
FIG. 3 is a front elevation view of the device of FIG. 1.
Figure 4:
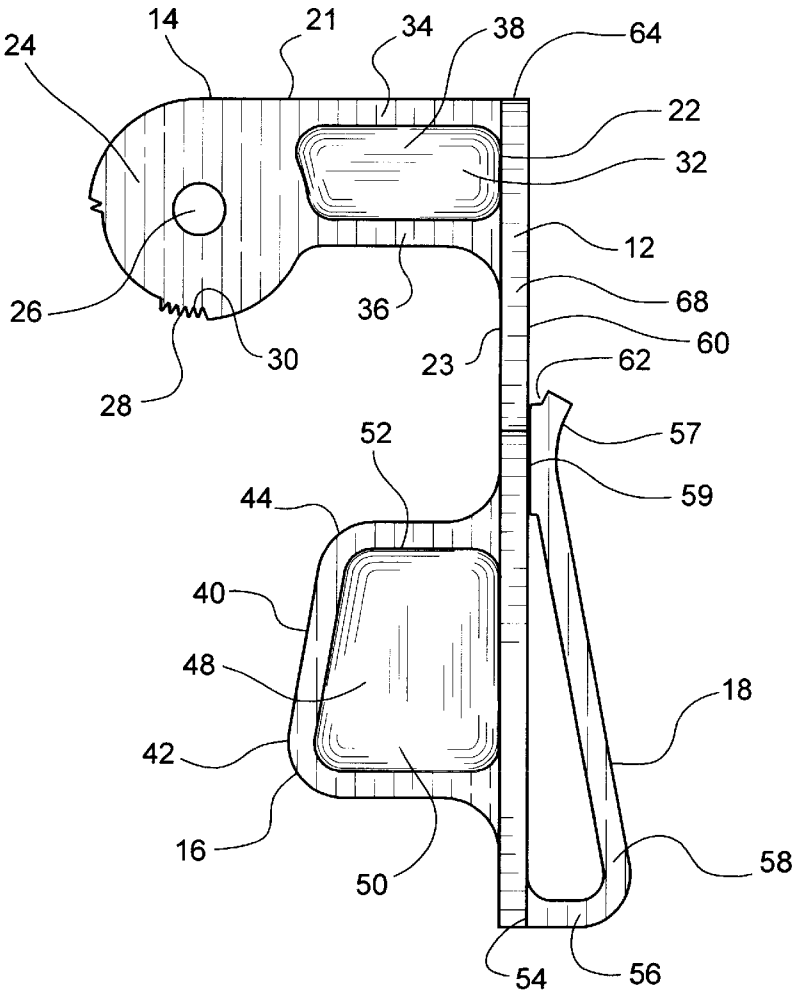
FIG. 4 is a right side elevation view of the device of FIG. 1.
Figure 5:
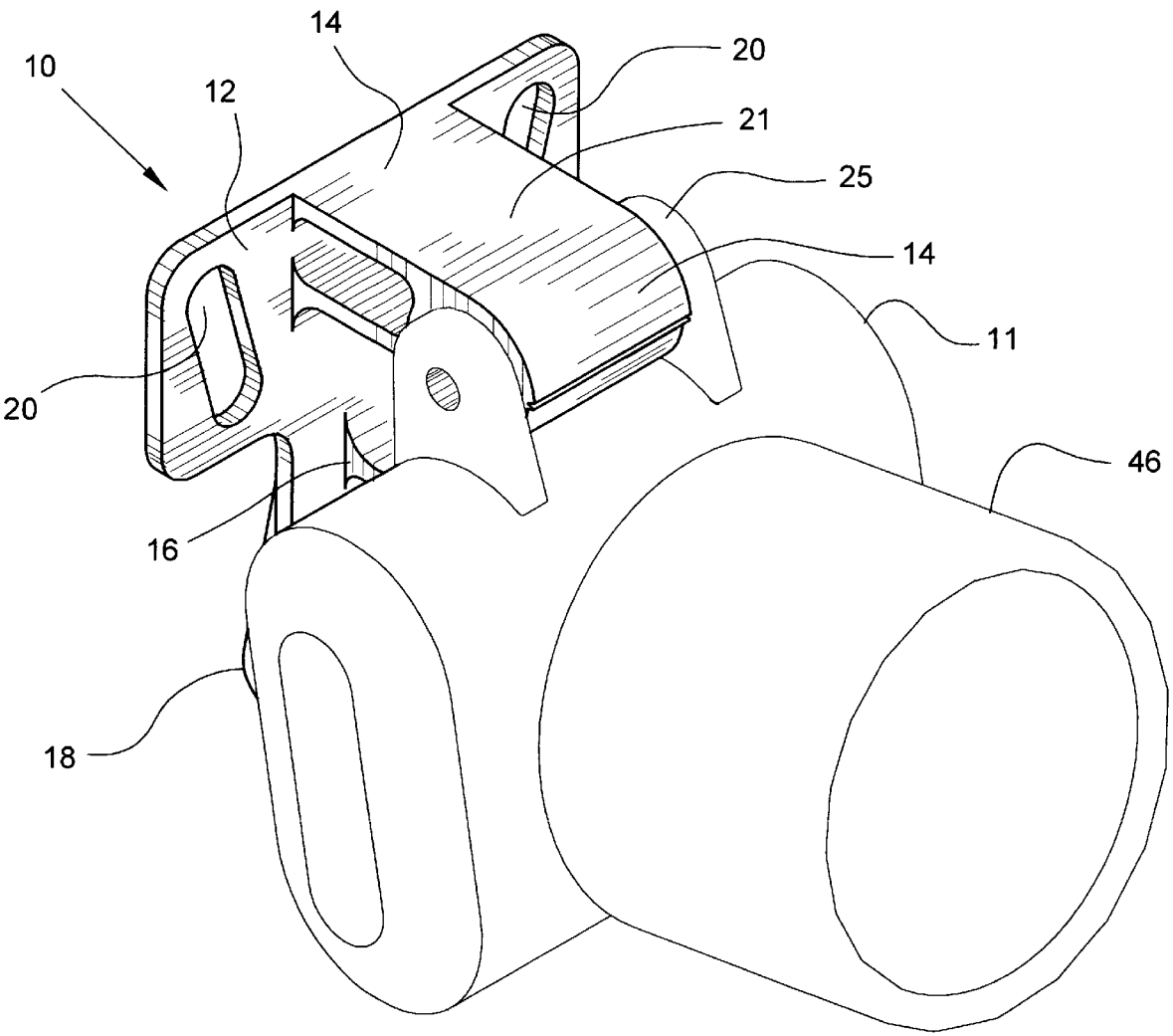
FIG. 5 is a perspective view of the device supporting a lighting apparatus in accordance with the present invention.
Figure 6:
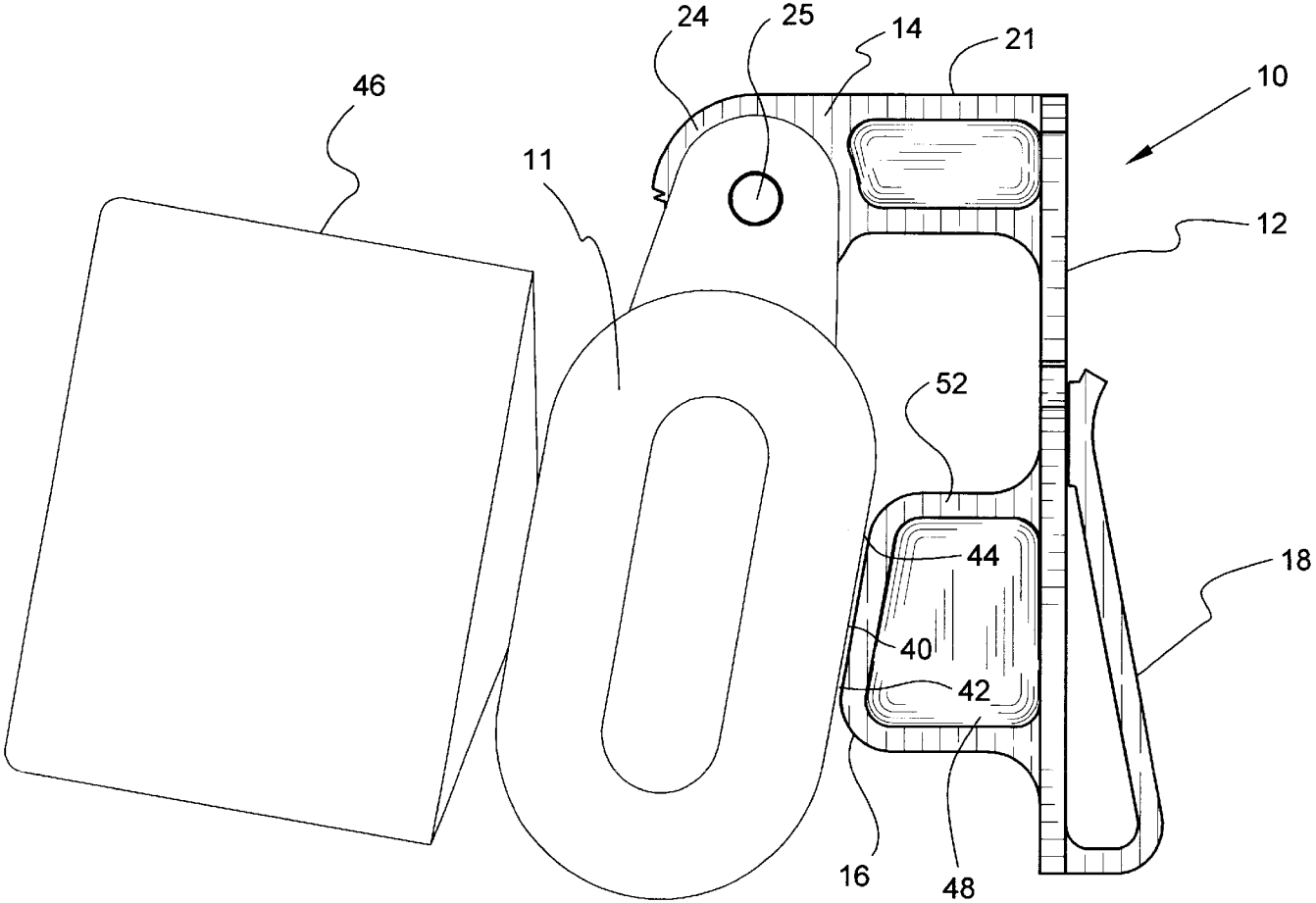
FIG. 6 is a right side elevation view of the device and lighting apparatus of FIG. 5.
Figure 7:
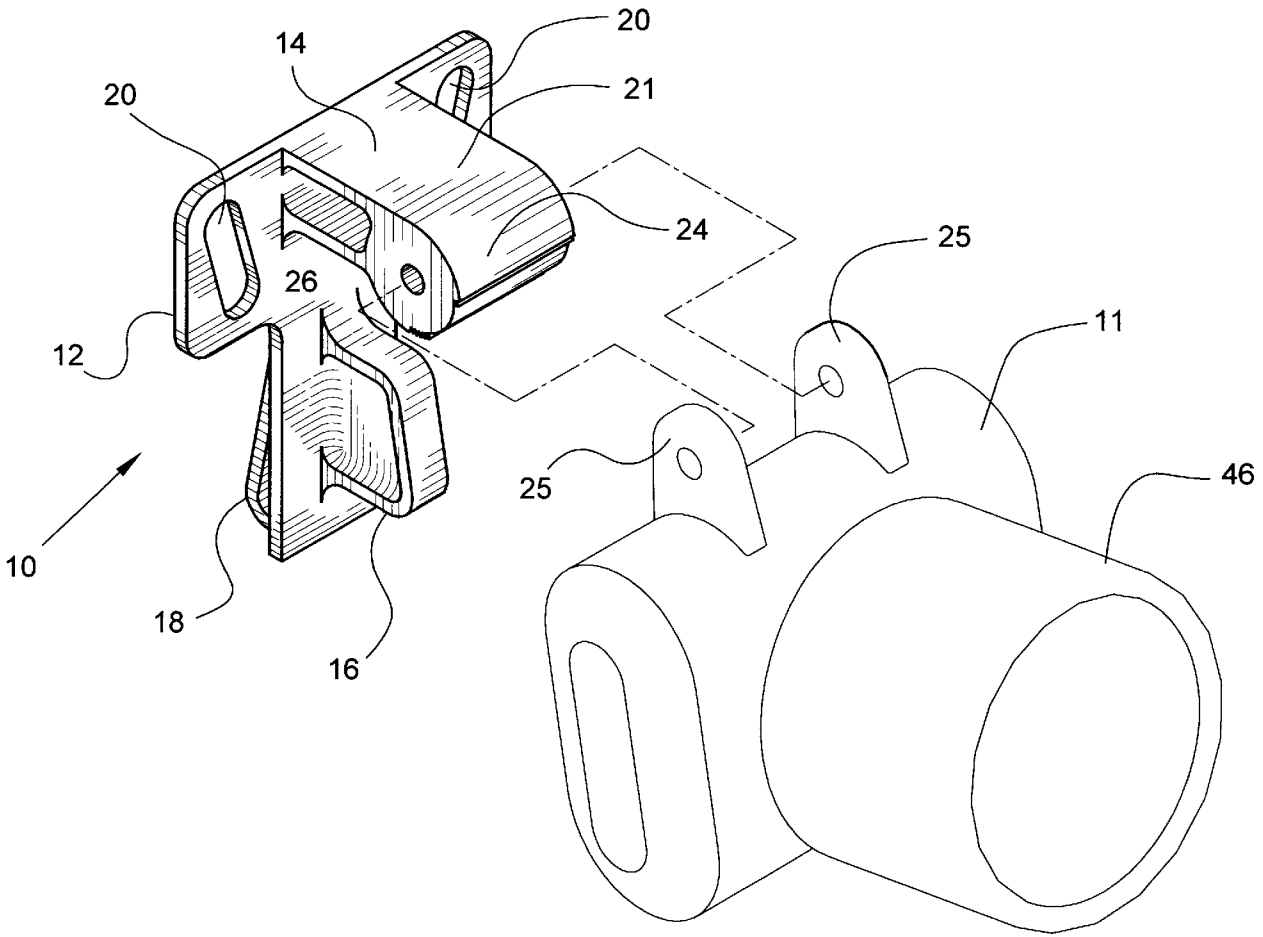
FIG. 7 is an exploded perspective view of the device and lighting apparatus of FIG. 5.

Referring now to the figures an in particular to FIGS. 1–4, a device for securing a lighting apparatus to a paintball mask (not shown) is denoted by numeral 10. The device 10 is fabricated from low density polyethylene or similar material that is light weight, relatively deformable, and capable of supporting a lighting apparatus 11 (not part of the device 10, see FIGS. 5–7) and functioning in any outdoor temperature or weather condition. A typical lighting apparatus 11 is manufactured by Princeton Tech, Inc., a company located in New Jersey. The device 10 can be an integrally molded unit or an assembly of discrete components. The device 10 includes a substantially "T" configured base member 12, a light support member 14, a light positioning member 16, a stabilizing clip 18 and a pair of belt receiving apertures 20.

The light support member 14 is joined to a first or front, upper mid-portion 22 of the base member 12. The light support member 14 is configured and dimensioned to perpendicularly extend from a planar front wall 23 of the base member 12, a distance that facilitates the removable securing of the lighting apparatus 11 to the device 10. The light support member 14 includes an extension portion 21 and a substantially cylindrical portion 24 integrally joined thereto. The cylindrical portion 24 has an axial dimension that allows the cylindrical portion 24 to be snugly inserted between cooperating mounting members 25 of the lighting apparatus 11. The cylindrical portion 24 includes an aperture 26 therethrough and a plurality of ridges 28 arcuately disposed upon a lower portion 30. The aperture 26 is axially centered through the cylindrical portion 24 and includes a diameter sized to snugly receive a securing bolt (not shown) that extends through the mounting members 25 of the lighting apparatus 11 and the aperture 26 thereby removably joining the lighting apparatus 11 to the support member 14; the position of the securing bolt ultimately being maintained by a securing nut (not shown) threaded upon one end of the bolt. The ridges 28 of the cylindrical portion 24 are configured and dimensioned to engage with a cooperating portion of the lighting apparatus 11 to minimize movement of the lighting apparatus 11 in relation to the device 10 when the device 10 is in operation. To reduce the weight of the device 10, the extension portion 21 of the light support member 14 includes a pair of opposing recesses 32 that form upper and lower walls 34 and 36 having relatively small lateral dimensions when compared to corresponding longitudinal dimensions. Further, the recesses 32 extend to similar depths to form a rib 38 having a relatively small lateral dimension separating the two recesses 32. The rib 38 is positioned perpendicularly to the base member 12 at a mid-portion of the extension portion 21.

The light positioning member 16 protrudes from a front, lower mid-portion of the base member 12 a perpendicular distance relatively shorter than the perpendicular distance separating the base member 12 and the aperture 26 of the cylindrical portion 24. The light positioning member 16 has a relatively square shaped configuration, when taking a side elevation view of the device 10 (see FIG. 4), and includes an outer wall 40 that is configured and dimensioned to engage a corresponding portion of the lighting apparatus 11 that promotes stability when the device 10 is operated. The outer wall 40 provides a surface that orientates the lighting apparatus 11 such that an emitted beam of light is upwardly angled. More specifically, a lower portion 42 of the outer wall 40 protrudes slightly farther from the base member 12 than does an upper portion 44 of the outer wall 40. When the lighting apparatus 11 is attached to the light support member 14 and allowed to pivot (see FIG. 6), the lighting apparatus 11 engages the lower and upper portions 42 and 44 of the outer wall 40 such that the light 46 of the lighting apparatus 11 is angled opposite to the base member 12 in a generally upward direction.

The light positioning member 16 further includes a pair of opposing recesses 48 configured and dimensioned to provide a rib 50 longitudinally aligned with the rib 38 of the light support member 14, the rib 50 being capable of supporting the lighting apparatus 11 during operation of the device 10. The recesses 48 are relatively large and form side walls 52 having a relatively small surface area thereby minimizing the quantity of material forming the light positioning member 16 to further reduce the weight of the device 10.

The stabilizing clip 18 is integrally joined to a back, bottom mid-portion 54 of the base member 12. The stabilizing clip 18 is configured and dimensioned to receive a player selected, cooperating lower portion of the paintball mask to prevent the bottom portion 54 of the device 10 from moving while the device is being used and without obstructing the vision of the player. Further, the clip 18 and lower mask portion positions the device such that the lighting apparatus 11 illuminates an area of safety in a forward direction relative to the player. The clip 18 includes a lower member 56 that is substantially perpendicular to the front wall 23 and extends upward to form an angled portion 58 that includes an end portion 57 having a planar engagement wall 59 which removably contacts a vertical mid-portion of a planar back wall 60 of the device 10. The lower member 56 and angled portion 58 are sized to removably receive the cooperating paintball mask portion, and are configured to generate sufficient "grasping" force to maintain the mask portion within the stabilizing clip 18 irrespective of the movement of the mask. To facilitate the insertion of the cooperating mask portion into the clip 18, the end portion 57 of the clip 18 includes a lifting ridge 62 that allows a finger to separate the engagement wall 59 of the angled portion 58 from the back wall 60 of the device 10 thereby providing the required space for insertion.

The belt receiving apertures 20 are horizontal disposed at opposing ends of the top portion of the "T" configured base member 12. The apertures 20 have a substantially elongated "slot" configuration and are orientated such that the longitudinal axes form an acute angle with a top wall 64 of the base member 12. Further, the aperture 20 orientation includes upper portions 66 of the apertures 20 being positioned closer to side walls 68 of the base member 12 than corresponding lower portions 70 of the apertures 20. The aperture 20 orientation may be reversed such that the upper portions 66 of the apertures 20 are positioned farther from the side walls 68 than corresponding lower portions 70. The aperture 20 orientation allows a support belt 72 to insert through the device 10, and maintains the position of the device 10 relative to the belt 72 irrespective of the magnitude of movement between the device 10 and belt 72.

In operation, a device 10 for securing a lighting apparatus 11 to a paintball mask receives a support belt 72 through opposing apertures 20, and receives a portion of the paintball mask in a stabilizing clip 18 thereby attaching the device 10 to the paintball mask. A cylindrical portion 24 of a light support member 14 is positioned between and secured to mounting members 25 of the lighting apparatus 11. A light positioning member 16 of the device 10 engages and orientates the lighting apparatus 11 such that an emitted beam of light is angled in a generally upward direction. The position of the lighting apparatus 11 is maintained by a tightened securing bolt and nut and a series of ridges 28 upon a lower portion of the cylindrical portion 24 engaging a corresponding portion of the lighting apparatus 11 thereby allowing an user of the device 10 to play night paintball in a safe manner.

Night paintball may be played indoors or outside upon a playing area of substantial size with established boundaries and features such as bunkers, pallets, barrels, or other structures that promote the play of paintball. The game of night paintball includes substantially the same game objective (all players on a first team are struck with paintballs "shot" by players of a second team before all players on the second team are struck with paintballs shot by players of the first team), field judges or referees, and equipment used to play day paintball. The equipment used in day paintball includes a safety mask (manufactured by J.T. U.S.A., Inc.) that protects a players face and ears, a paintball gun (manufactured by Pursuit Marketing, Inc. located in Schiller Park, Ill.) that propels a spherical paintball a predetermined distance with sufficient force to collapse an outer paintball shell and splatter paint therein upon striking an opposing player, and armbands or clothing for identifying different teams. The added equipment required for night paintball includes the above described lighting apparatus 11 and securing device 10 for attaching the lighting apparatus 11 to the safety mask, a luminescent paintball and a luminescent armband or similar means for player identification in the dark.

The luminescent paintball is fabricated substantially the same as a standard paintball used in a game of paintball played during daylight hours. The shell of the luminescent paintball may be translucent, transparent or dyed. The typical daylight paintball is manufactured by R. P. Scherer, Inc. To convert the standard paintball to a luminescent paintball for night paintball use, one of three methods may be utilized: 1) A glow powder is disposed within a transparent, gelatin material of the spherical shell; 2) the glow powder is adhered to an exterior portion of the spherical shell via an adhesive well known to those of ordinary skill, thereby coating the outer surface of the shell; or 3) the glow powder is mixed with the liquefied substance that is disposed inside the spherical shell.

The glow powder is a commercially sold, nontoxic, non-radioactive phosphorus based powder such as stromium with a preferred particle size of 125 to 500 mesh pass, although a particle size outside the stated range can be used, but with a resultant light intensity less than preferred. The glow powder should be capable of producing light for up to at least eight hours. Alternatively, there may be an occasion that will require the glow powder to produce light for substantially less than eight hours. The glow powder glows in the dark after being exposed to a preselected light for a predetermined period of time which corresponds to a time period that the powder is required to glow. These parameters are well known to those of ordinary skill in the art.

The luminescent armband is essentially a standard armband used in daylight paintball competition with the addition of a luminous powder and standard screen print ink mixture configured thereupon to form images, letters, words or symbols. The preferred powder to ink mixture is such that two parts of ink are combined with one part of powder, although this ratio may vary when armband visibility parameters change.

The powder is a non-toxic, non radioactive, stromium based powder having a particle size preferably in the range of 125 to 500 mesh, although sizes outside the stated range may be used but with less than desired results. The powder has a photo-storage capability that, upon being charged by a light, will provide the glow required to identify a player from a minimum predetermined distance.

The powder-ink mixture is applied to an armband and allowed to dry. The powder-ink mixture is then charged for a predetermined period of time by exposure to a preselected light. The exposure time and type of light correspond to the required glow time which ultimately depends upon the time to play a game of night paintball. Ultraviolet light is the light of preference and the exposure time is generally between twenty minutes and twelve hours depending on the amount of time to prepare and play a game of night paintball. Generally, the more players and/or teams participating, the longer the time to prepare and play, and the greater the exposure time required.

After the armbands are glowing, the night paintball players wrap or slide the armbands upon their arm or other body portion designated by the paintball park officials thereby establishing teams based upon colors, symbols, images, or names printed on the armband.

An alternative to using an armband, is substituting therefor a chemical light that is ultimately positioned in a transparent pocket on the outside of a standard armband. The chemical light would have a preselected color to identify a player as belonging to a particular team.

The foregoing description is for purposes of illustrating only and is not intended to limit the scope of protection accorded this invention. The scope of protection is to be measured by the following claims, which should be interpreted as broadly as the inventive contribution permits.

What is claimed and desired to be secured by Letters Patent of the United States is:

1. A device for securing a lighting apparatus to a paintball mask comprising:

means for joining the lighting apparatus to a base member of said device;

means for positioning the lighting apparatus, said positioning means includes a plurality of members for distally disposing a plurality of portions of the lighting apparatus at inconstant distances relative to said base member; and means for connecting said base member to the paintball mask.

2. The device of claim 1 wherein said joining means includes a light support member.

3. The device of claim 2 wherein said light support member includes means for maintaining a preselected orientation of the lighting apparatus in relation to said device.

4. The device of claim 3 wherein said maintaining means includes a plurality of ridges that engage cooperating portions of the lighting apparatus.

5. The device of claim 4 wherein said ridges are disposed upon an arcuate portion of said maintaining means.

6. The device of claim 1 wherein said distal disposing means orientates the lighting apparatus such that a light beam emitted from the apparatus is focused in a generally upward direction relative to said paintball mask when said base member is disposed in a substantially vertical position.

7. The device of claim 1 wherein said device is manufactured from low density polyethylene.

8. The device of claim 1 wherein said connecting means includes means for receiving a belt therethrough.

9. The device of claim 8 wherein said belt receiving means includes opposing apertures in said base member.

10. The device of claim 9 wherein said apertures include slots angled such that corresponding upper portions are farther separated than corresponding lower portions.

11. The device of claim 1 wherein said connecting means includes a clip portion.

12. The device of claim 11 wherein said clip portion is disposed vertically opposite from said belt receiving means.

13. The device of claim 11 wherein said clip portion receives a lower portion of the paintball mask therein.

14. The device of claim 1 wherein said joining means and said positioning means include pairs of opposing recesses.

15. The device of claim 1 wherein said base member forms substantially a "T" configuration when taking a front elevation view of the device.

16. A device for securing a lighting apparatus to a paintball mask comprising:

means for joining the lighting apparatus to a base member of said device;

means for positioning the lighting apparatus, said positioning means includes a light positioning member for spatially separating a corresponding portion of the lighting apparatus from said base member a relatively shorter distance than the spatial separation between a portion of the lighting apparatus attached to said joining means and a cooperating portion of said base member; and means for connecting said base member to the paintball mask.

17. The device of claim 16 wherein said light positioning member adjusts the lighting apparatus such that a light beam emitted from the apparatus angles upward relative to said device.

* * * * *